US008691396B2

(12) United States Patent
Yuse et al.

(10) Patent No.: US 8,691,396 B2
(45) Date of Patent: Apr. 8, 2014

(54) GALVANNEALED STEEL SHEET AND PRODUCTION METHOD THEREOF

(75) Inventors: Fumio Yuse, Kobe (JP); Mikako Takeda, Kobe (JP); Shigenobu Namba, Kobe (JP); Yoshihiro Miyake, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 361 days.

(21) Appl. No.: 13/128,194

(22) PCT Filed: Nov. 2, 2009

(86) PCT No.: PCT/JP2009/068780

§ 371 (c)(1),
(2), (4) Date: May 6, 2011

(87) PCT Pub. No.: WO2010/053074

PCT Pub. Date: May 14, 2010

(65) Prior Publication Data

US 2011/0212337 A1 Sep. 1, 2011

(30) Foreign Application Priority Data

Nov. 6, 2008 (JP) ..... 2008-285705

(51) Int. Cl.

| | |
|---|---|
| ***B32B 15/04*** | (2006.01) |
| ***B32B 15/18*** | (2006.01) |
| ***B32B 15/20*** | (2006.01) |
| ***B05D 3/00*** | (2006.01) |
| ***B05D 3/02*** | (2006.01) |
| ***B05D 1/18*** | (2006.01) |

(52) U.S. Cl.
USPC ..... 428/659; 428/684; 427/372.2; 427/433; 427/329; 427/436

(58) Field of Classification Search
USPC ..... 428/659, 658, 684
See application file for complete search history.

(56) References Cited

U.S. PATENT DOCUMENTS

| | | | | |
|---|---|---|---|---|
| 2004/0055667 | A1 * | 3/2004 | Takada et al. | 148/533 |
| 2010/0006184 | A1 | 1/2010 | Takeda et al. | |

FOREIGN PATENT DOCUMENTS

| | | | |
|---|---|---|---|
| JP | 6 88193 | | 3/1994 |
| JP | 9 25537 | | 1/1997 |
| JP | 9 25538 | | 1/1997 |
| JP | 09 263883 | | 10/1997 |
| JP | 09 263884 | | 10/1997 |
| JP | 2001 279410 | | 10/2001 |
| JP | 2001-303229 | * | 10/2001 |
| JP | 2003 328036 | | 11/2003 |
| JP | 2004 263271 | | 9/2004 |
| JP | 2005 200711 | | 7/2005 |

OTHER PUBLICATIONS

Machine Translation, Takada et al., JP 2001-303229, Oct. 2001.*
International Search Report issued Dec. 1, 2009 in PCT/JP09/068780 filed Nov. 2, 2009.
Office Action issued Dec. 1, 2009 in Japanese Patent Application No. 2008-285705 filed Nov. 6, 2008 (with English language translation).
Office Action issued Jul. 4, 2012 in Chinese Patent Application No. 200980144091.3 (with English translation).
United Kingdom Office Action issued Apr. 26, 2013, in Patent Application No. GB 1107555.3.

* cited by examiner

*Primary Examiner* — Michael E La Villa
(74) *Attorney, Agent, or Firm* — Oblon, Spivak, McClelland, Maier & Neustadt, L.L.P.

(57) ABSTRACT

A galvannealed steel sheet obtained by subjecting a base steel sheet to hot-dip galvanization and then alloying the galvanization layer, the base steel sheet being obtained by hot rolling a specified steel. A method for producing the galvannealed steel sheet.

10 Claims, No Drawings

GALVANNEALED STEEL SHEET AND PRODUCTION METHOD THEREOF

TECHNICAL FIELD

The present invention relates to a galvannealed steel sheet and a production method thereof.

BACKGROUND ART

Hot-dip galvanized steel sheets (galvanized steel sheets) are used in wide ranging applications such as automobiles, house-hold appliances, and constructional materials. Among them, galvannealed steel sheets (alloyed galvanized steel sheets) excel in corrosion resistance and spot weldability and are thereby widely used as materials for automobiles. Such galvannealed steel sheets are prepared by subjecting a galvanized steel sheet to a heat treatment to alloy a galvanized layer and a base steel sheet (steel sheet before hot-dip galvanization).

Base steel sheets for use in automobiles should have higher strengths and have smaller thicknesses, because automobiles should be reduced in body weight to improve fuel efficiency and should have higher strengths to improve collision safety. However, regular base steel sheets, if designed to have higher strengths, show inferior ductility. To avoid this, demands have been made to provide base steel sheets having strength and ductility in good balance.

To further improve both strength and ductility while maintaining good balance between them, the addition of silicon (Si) and/or manganese (Mn) may be performed. However, the addition of Si and/or Mn may significantly adversely affect plating wettability and alloying performance, because these elements are oxidizable elements and are thereby oxidized during annealing performed before hot-dip galvanization. Such poor wettability may cause uneven deposition of a plated layer on the surface of the base steel sheet and thereby cause unplated portions. The resulting plated layer, if deposited, may have a wavy "ripple" pattern on the surface and have poor appearance. The defective plating often causes uneven alloying, thereby impedes the control of alloying conditions, and impedes stable production of the galvannealed steel sheets.

In addition, the generation of defective plating (generation of unplated portions and generation of a ripple pattern) and the generation of uneven alloying cause inferior powdering resistance, which causes the plated layer to be peeled off from the base steel sheet in processing of the part, resulting in poor surface appearance. Techniques for solving these problems are disclosed in Patent Literature (PTL) 1 to 5.

PTL 1 discloses a technique of improving wettability between a base steel sheet and a galvanized layer by removing the surface layer of the annealed base steel sheet through dry etching prior to the immersion in a galvanizing bath. Such improved wettability prevents the generation of defective plating and uneven alloying. PTL 2 discloses a technique of applying a sulfur-containing ammonium salt to the surface of a high-tensile-strength steel sheet containing manganese (Mn), subjecting the steel sheet to a heat treatment, and subjecting the heat-treated steel sheet to a hot-dip galvanization. PTL 3 discloses a technique for improving platability (the property of galvannealed coating) by controlling the thermal hystereses before and after hot-dip galvanization to thereby improve coating adhesion in a width direction of a galvannealed steel sheet using a steel containing silicon (Si) and phosphorus (P) in high contents, thus avoiding uneven plating. PTL 4 discloses a technique of annealing a high-tensile-strength steel sheet in a continuous annealing furnace having a heating zone of clean heating furnace type or direct heating furnace type, removing 70% or more of a surface enriched layer typically of Si, Mn, and Al through acid pickling, and performing hot-dip galvanization. PTL 5 discloses a technique of forming a reaction product in a surface layer of a steel sheet in an annealing process of the steel sheet to be plated, which reaction product is formed between an added element in the steel sheet and a component of the annealing atmosphere.

The techniques disclosed in PTL 1 to 4, however, require complicated production processes, because they require dry etching process before hot-dip galvanization, application of an ammonium salt to the steel sheet, control of the thermal hystereses before and after hot-dip galvanization, or control of the acid pickling conditions. Independently, a reaction product, if formed on the surface of the base steel sheet as in the technique disclosed in PTL 5, may contrarily cause defective plating and/or uneven alloying.

Incidentally, galvannealed steel sheets are superior in corrosion resistance to base steel sheets. However, the improvement in corrosion resistance significantly depends on the mass of coating of the galvanized layer, and the mass of coating has an upper ceiling. For further improving corrosion resistance, painting of the surface of the galvannealed layer or addition of Al or Mg to the galvannealed layer may be performed. However, the painting may cause defects and causes higher cost. Independently, the addition of Al or Mg to the galvannealed layer also inevitably causes higher cost. Even the corrosion resistance of the galvannealed layer itself is increased by the addition of Al or Mg, if the galvannealed layer is peeled off from the base steel sheet, the steel sheet shows significantly impaired corrosion resistance in the end.

CITATION LIST

Patent Literature

PTL 1: Japanese Unexamined Patent Application Publication No. 06-88193

PTL 2: Japanese Unexamined Patent Application Publication No. 2001-279410

PTL 3: Japanese Unexamined Patent Application Publication No. 2003-328036

PTL 4: Japanese Unexamined Patent Application Publication No. 2004-263271

PTL 5: Japanese Unexamined Patent Application Publication No. 2005-200711

SUMMARY OF INVENTION

Technical Problem

The present invention has been made under these circumstances, and an object thereof is to provide a galvannealed steel sheet which less suffers defective plating and uneven alloying and excels in surface appearance. Another object of the present invention is to provide a method for producing the galvannealed steel sheet.

Solution to Problem

The present invention has achieved the above objects and provides a galvannealed steel sheet obtained by subjecting a base steel sheet to hot-dip galvanization and then alloying the galvanization layer, the base steel sheet being obtained by hot rolling a steel, the steel containing carbon (C) in a content of 0.02 to 0.25 percent by mass, silicon (Si) in a content of 0.5 to 3 percent by mass, manganese (Mn) in a content of 1 to 4 percent by mass, chromium (Cr) in a content of 0.03 to 1 percent by mass, aluminum (Al) in a content of 1.5 percent by mass or less (exclusive of 0 percent by mass), phosphorus (P) in a content of 0.03 percent by mass or less (exclusive of 0 percent by mass), sulfur (S) in a content of 0.03 percent by mass or less (exclusive of 0 percent by mass), and titanium (Ti) in a content of 0.003 to 1 percent by mass, and further containing copper (Cu) in a content of 0.25 to 5.0 percent by mass and nickel (Ni) in a content of 0.05 to 1.0 percent by mass so that the copper and nickel contents satisfy following Condition (1), with the remainder including iron and inevitable impurities. In Condition (1), [Cu] and [Ni] represent the contents (percent by mass) of Cu and Ni, respectively:

$$[Cu]/[Ni] \geq 5 \quad (1)$$

In preferred embodiments, the galvannealed steel sheet is such that:

(i) the base steel sheet has a metal structure containing ferrite and martensite in a total content of 70 percent by area or more and having a controlled content of retained austenite of 1 percent by area or less (inclusive of 0 percent by area); or (ii) the base steel contains Si in a content of 1 percent by mass or more, and the galvannealed steel sheet has a metal structure containing retained austenite in a content of 3 percent by area or more.

In the embodiment (ii), the retained austenite (hereinafter also referred to as retained γ) preferably has an average axial ratio ((major axis)/(minor axis)) of grains of 5 or more.

The galvannealed steel sheet preferably further contains at least one of following (a), (b), and (c) as additional element(s):

(a) one or more elements selected from the group consisting of vanadium (V) in a content of 1 percent by mass or less (exclusive of 0 percent by mass), niobium (Nb) in a content of 1 percent by mass or less (exclusive of 0 percent by mass), and molybdenum (Mo) in a content of 1 percent by mass or less (exclusive of 0 percent by mass);

(b) boron (B) in a content of 0.1 percent by mass or less (exclusive of 0 percent by mass); and/or (c) calcium (Ca) in a content of 0.005 percent by mass or less (exclusive of 0 percent by mass) and/or magnesium (Mg) in a content of 0.01 percent by mass or less (exclusive of 0 percent by mass).

The galvannealed steel sheet according to the present invention may be produced by hot-rolling a steel having a composition satisfying the above conditions to give a base steel sheet, subjecting the base steel sheet to hot-dip galvanization to give a galvanized steel sheet, and alloying the galvanized steel sheet.

Advantageous Effects of Invention

The present invention applies galvannealing to a base steel sheet containing Cu and Ni in good balance and thereby gives a galvannealed steel sheet which less suffers defective plating and uneven alloying and has a good surface appearance.

DESCRIPTION OF EMBODIMENTS

A feature of the present invention is the application of galvannealing to a base steel sheet containing Cu and Ni in good balance to give a galvannealed steel sheet (hereinafter also referred to as a GA steel sheet) which less suffers defective plating and uneven alloying and excels in surface appearance.

GA steel sheets according to the present invention include both a dual phase (DP) steel sheet containing substantially no retained γ and a transformation induced plasticity (TRIP) steel sheet containing retained γ in a content of 3 percent by area or more, and both the GA steel sheets also effectively exhibit effects by the action of the respective microstructures. As used herein, the term "base steel sheet" refers to a steel sheet before subjected to hot-dip galvanization and is distinguished from a galvanized steel sheet (GI steel sheet) and a GA steel sheet.

Initially, what led up to the present invention will be described. The present inventors made investigations on prevention of defective plating and uneven alloying in a GA steel sheet containing large amounts of oxidizable elements such as Si and Mn, in order to improve the balance between strength and ductility. As has been described above, when the base steel sheet contains Si and/or Mn in a high content so as to improve the strength and ductility, the added Si and/or Mn is selectively oxidized in an annealing process performed before hot-dip galvanization. The resulting oxides of Si and/or Mn diffuse to the surface of the base steel sheet and form an oxide layer which will cause defective plating. The oxide layer will also cause uneven alloying when the galvanized steel sheet is subjected to a heat treatment to alloy the galvanized layer. Particularly when Si is enriched in the surface of the base steel sheet, it forms a thin oxide layer as an outermost surface of the base steel sheet and causes internal oxidation, resulting in significantly poor coating adhesion (adhesion of the plated layer to the base steel sheet) and alloying performance. In contrast, Mn is also enriched in the surface of the base steel sheet, but the resulting manganese oxide (MnO) formed through oxidation of Mn is granular, thereby has a lower barrier effect than that of the silicon oxide layer. The barrier effect is inhibition of the outward diffusion of iron (Fe) during alloying. For this reason, Mn, if added in a small content, may not so adversely affect the alloying rate. However, Mn should be added in a larger content than that of Si so as to improve the strength and ductility, and such large amount of Mn forms a large amount of MnO in the surface of the base steel sheet. This causes the alloying behavior to be complicated and impedes the control of the alloying conditions.

Under these circumstances, the present inventors focused attention on the relationship between the alloying of the galvanized layer and the silicon and manganese oxides formed in the surface of the base steel sheet. The present inventors considered that the resulting galvannealed steel sheet less suffers defective plating and uneven alloying and has a good appearance by suppressing the formation of the oxides in the surface of the base steel sheet, thereby improving the wettability between the base steel sheet and molten zinc, and improving the reactivity between the base steel sheet and zinc. Based on this consideration, the present inventors focused attention on Cu and Ni as elements which suppresses the silicon oxide and manganese oxide. As a result, the present inventors have found that the incorporation of Cu and Ni in good balance to a base steel sheet containing Si and Mn in high contents reduces defective plating. Defective plating is reduced probably because Cu, as enriched in the surface of the base steel sheet, suppresses the oxidation of Si and Mn in the surface of the base steel sheet. Incorporation of Ni in combination with Cu allows the Cu-enriched layer to have a higher melting point and thereby prevents the generation of flaws and cracks during hot working. In addition, the combination of Cu and Ni improves the coating adhesion, probably because Cu and Ni have high reactivity with Zn in the galvanized layer. Specifically, the present inventors have found that the Cu enriched layer further containing Ni contributes not only to the reduction of defective plating but also to the improvement of the wettability with molten zinc (galvanized layer), this allows the alloying reaction to proceed uniformly and thereby reduces also the generation of unplated portions and defective alloying.

In addition, the use of the base steel sheet containing Cu also improves the corrosion resistance of the GA steel sheet. Specifically, even when part of the galvanized layer is corroded, Cu (partially synergistically with Ni and Ti) affects the dissolution of Zn and Fe to cause the resulting zinc rust and iron rust to have smaller dimensions, and this allows the rust layer itself to have improved corrosion resistance. In other words, the zinc plating, even when corroded, forms fine and compact zinc rust and thereby allows the galvannealed steel sheet to have still improved corrosion resistance. Likewise, iron in the base steel sheet, even when corroded, forms dense iron rust and thereby allows the galvannealed steel sheet to have still improved corrosion resistance. The formation of the dense zinc rust and iron rust allows the galvannealed steel sheet as a whole to maintain improved corrosion resistance and to have a long life.

In addition, Cu itself is a noble metal, and the Cu-enriched layer functions as a barrier against the invasion of corrosive factors from outside and helps to further improve the corrosion resistance.

To form the Cu-enriched layer, the GA steel sheet according to the present invention contains Cu in a content of 0.25 to 5.0 percent by mass and Ni in a content of 0.05 to 1.0 percent by mass so that the ratio ([Cu]/[Ni]) of the Cu content to the Ni content be 5 or more. Cu and Ni elements are solid-solution strengthening elements, improve the strength, and improve the coating adhesion. In particular, Cu is more resistant to oxidation than Fe is, and, when enriched in the surface of the base steel sheet, helps to change the dimensions of the silicon oxide and manganese oxide, and prevents the deterioration of coating adhesion. Specifically, the enrichment of Cu in the vicinity of grain boundaries in the surface suppresses the formation of the silicon oxide and manganese oxide and thereby reduces defective plating. The suppression of the formation of the silicon oxide and manganese oxide improves the wettability between the base steel sheet and the molten zinc, thereby helps the alloying reaction to proceed uniformly, and reduces the generation of uneven alloying.

According to the present invention, both Cu and Ni are added to the steel, because the addition of Cu alone may cause flaws and cracks in the surface during hot rolling process of the steel. Specifically, if a Cu-enriched layer containing no Ni but Cu alone is exposed to elevated temperatures, part of the layer is converted into a liquid phase, and the surface of the base steel sheet, which bears the liquid phase and thereby becomes fragile, causes flaws and cracks when subjected to hot working. To avoid the generation of flaws and cracks in the surface, the steel herein contains Ni in combination with Cu as essential elements. This is because the presence of Ni allows the Cu-enriched layer to have a higher melting point and thereby prevents the generation of flaws and cracks during hot working.

To exhibit these effects, the steel should contain Cu in a content of 0.25 percent by mass or more. The Cu content is preferably 0.3 percent by mass or more, and more preferably 0.35 percent by mass or more. However, the steel, if containing Cu in excess, may have poor workability, and the upper limit of the Cu content is 5.0 percent by mass. The Cu content is preferably 4 percent by mass or less, and more preferably 3 percent by mass or less.

Independently, the steel should contain Ni in a content of 0.05 percent by mass or more. The Ni content is preferably 0.06 percent by mass or more. However, the steel, if containing Ni in excess, may have poor workability, and the upper limit of the Ni content is 1.0 percent by mass. The Ni content is preferably 0.8 percent by mass or less, and more preferably 0.6 percent by mass or less.

The GA steel sheet according to the present invention contains Cu and Ni as essential elements, and it is important that the ratio ([Cu]/[Ni]) of the Cu content to the Ni content satisfies following Condition (1). The GA steel sheet, if merely containing Cu and Ni in the above ranges without control of the ratio between them, may not have a satisfactory appearance. Though slightly, the addition of Ni adversely affects the enrichment of Cu, and if the Cu and Ni contents are in poor balance, the Cu-enriched layer may be discontinuous in width and thickness. Such discontinuous Cu-enriched layer contrarily causes uneven alloying, because the coating adhesion and alloying rate vary between a portion where the Cu-enriched layer is present and another portion where the Cu-enriched layer is absent.

$$[Cu]/[Ni] \geq 5 \quad (1)$$

If the ratio [Cu]/[Ni] is less than 5, excessive Ni impedes the formation of a desired Cu-enriched layer as a uniform enriched layer. To avoid this, the ratio [Cu]/[Ni] is 5 or more, preferably 5.5 or more, and more preferably 6 or more.

A theoretical upper limit of the ratio [Cu]/[Ni] is 100, but the ratio [Cu]/[Ni] is preferably 50 or less, because highly excessive Cu with respect to Ni may cause cracks or may invite higher cost. The ratio [Cu]/[Ni] is more preferably 40 or less, and furthermore preferably 30 or less.

As used herein the term "Cu-enriched layer" refers to a layer which is formed during the hot rolling process of an ingot steel, is formed to a thickness of several micrometers to several tens of micrometers, and has a Cu concentration two times or more higher than the Cu concentration in the mid-portion of the steel sheet in a thickness direction. Specifically, the Cu-enriched layer is preferably continuously formed to a thickness of 1 μm or more in the vicinity of the surface of the base steel sheet. The Cu-enriched layer has a thickness of more preferably 3 μm or more. The Cu-enriched layer once formed in the vicinity of the surface of the base steel sheet reacts and partially dissolves when the base steel sheet is immersed in a galvanizing bath, and the Cu-enriched layer in the resulting GA steel sheet may show a thickness and a state different from initial ones in the observation of the vicinity of the surface. The Cu-enriched layer more satisfactorily exhibits the above effects by the addition of V, Nb, Mo, B, and other elements that are easily segregated at grain boundaries.

The GA steel sheet according to the present invention has a key feature in containing Cu and Ni in good balance, as has been described above.

Next, basic chemical compositions other than Cu and Ni will be described in the case of a DP steel sheet containing substantially no retained γ and in the case of a TRIP steel sheet containing retained γ in a content of 3 percent by area or more, respectively.

Base steel sheets for use in the present invention are classified, by the presence or absence of retained γ in the metal structure, as (a) a DP steel sheet containing ferrite and martensite in a total content of 70 percent by area or more and having a retained γ content of 1 percent by area or less (inclusive of 0 percent by area); and (b) a TRIP steel sheet containing retained γ in a content of 3 percent by area or more.

The use of the DP steel sheet (a) prevents the generation of cracks, because the DP steel sheet has a composite microstructure of ferrite and martensite as the matrix microstructure. In contrast, the TRIP steel sheet (b) contains retained γ in a content of 3 percent by area or more, and, when processed and deformed at a temperature equal to or higher than the martensite transformation start temperature (Ms point), the retained γ undergoes stress-induced transformation and is transformed into martensite, resulting in large elongation.

The metal structure of the base steel sheet may be analyzed by observing the thickness midportion of the steel sheet under a scanning electron microscope (SEM). The observation may be performed at a magnification of about 3000 times. The amount of retained γ may be determined using a field emission scanning electron microscope (FE-SEM) equipped with an electron backscattered pattern (EBSP) detector, as described in detail in Experimental Examples below.

<< (a) DP Steel Sheet Containing Ferrite and Martensite in a Total Content of 70 Percent by Area or More and Having a Controlled Content of Retained γ of 1 Percent by Area or Less (Inclusive of 0 Percent by Area)>>

[Carbon (C) in a Content of 0.02 to 0.25 Percent by Mass]

Carbon (C) element is necessary for ensuring strength, contributes to changing of the amount and state (structure) of a low-temperature transformation product, and affects the elongation and stretch flangeability. Accordingly, the base steel sheet should contain carbon in a content of 0.02 percent by mass or more. The carbon content is preferably 0.04 percent by mass or more, and more preferably 0.06 percent by mass or more. However, the base steel sheet, if containing carbon in a content of more than 0.25 percent by mass, shows insufficient weldability, and the carbon content is 0.25 percent by mass or less. Particularly in the case of the DP steel sheet, the carbon content is preferably 0.2 percent by mass or less, and more preferably 0.18 percent by mass or less.

[Silicon (Si) in a Content of 0.5 to 3 Percent by Mass]

Silicon (Si) element is a substitutional solid-solution strengthening element and contributes to the improvement of strength by reducing the content of dissolved carbon in the alpha layer. Silicon, if contained in a high content, increases the ferrite fraction and suppresses the bainite transformation of the low-temperature transformation phase to thereby accelerate the formation of martensite. This allows the metal structure to be a composite microstructure of ferrite and martensite. Accordingly, Si element also helps to improve the workability, such as elongation, of the high-strength steel sheet. To exhibit these effects satisfactorily, the base steel sheet should contain Si in a content of 0.5 percent by mass or more. The Si content is preferably 1 percent by mass or more, and more preferably 1.2 percent by mass or more. However, Si, if present in excess, may form a silicon oxide layer in the surface of the base steel sheet and thereby impair the wettability of coating, to fail to reduce defective plating and uneven alloying. In addition, excessive Si forms an oxide film in the surface of the base steel sheet during hot rolling, this increases the cost for the removal of scales and flaws and is economically disadvantageous. Even the base steel sheet contains Si in an excessively high content, the above-mentioned strength improving effects are saturated, and the base steel sheet suffers higher cost. For these reasons, the Si content is set to be 3 percent by mass or less. The Si content is preferably 2.5 percent by mass or less, and more preferably 2 percent by mass or less.

[Manganese (Mn) in a Content of 1 to 4 Percent by Mass]

Manganese (Mn) element is necessary for increasing the strength and ductility and should be contained in a content of 1 percent by mass or more. The Mn content is preferably 1.3 percent by mass or more, and more preferably 1.5 percent by mass or more. However, Mn, if present in excess, forms a manganese oxide layer in the surface of the base steel sheet and thereby impairs the wettability of plating to fail to reduce defective plating and uneven alloying, as with Si. In addition, excessive Mn forms an oxide film in the surface of the base steel sheet during hot rolling, and this increases the cost for the removal of scales and flaws and is economically disadvantageous. Even the base steel sheet contains Mn in an excessively high content, the above-mentioned strength improving effects are saturated, and the base steel sheet suffers higher cost. For these reasons, the Mn content is set to be 4 percent by mass or less. The Mn content is preferably 3.5 percent by mass or less. It is recommended particularly in the case of the DP steel sheet that the Mn content is 3 percent by mass or less.

[Chromium (Cr) in a Content of 0.03 to 1 Percent by Mass]

Chromium (Cr) element is effective to increase hardenability and to strengthen the microstructure.

Specifically, Cr allows carbon to be enriched in austenite, stabilizes the austenite to facilitate the formation of martensite, and thus strengthens the metal structure. Accordingly, Cr should be contained in a content of 0.03 percent by mass or more. The Cr content is preferably 0.1 percent by mass or more, and more preferably 0.15 percent by mass or more. However, the effects are saturated and the cost increases when Cr is contained in a content of more than 1 percent by mass, and the upper limit of the Cr content is set to be 1 percent by mass. The Cr content is preferably 0.8 percent by mass or less, and more preferably 0.6 percent by mass or less.

[Aluminum (Al) in a Content of 1.5 Percent by Mass or Less (Exclusive of 0 Percent by Mass)]

Aluminum (Al) element helps to improve corrosion resistance and hydrogen-embrittlement resistance. The addition of Al improves the hydrogen-embrittlement resistance, probably because the addition of Al improves the corrosion resistance, resulting in reduction of the amount of hydrogen generated through atmospheric corrosion. However, Al, if present in excess, may form large amounts of inclusions such as alumina and thereby impair the workability. To avoid this, the Al content is set to be 1.5 percent by mass or less. The Al content is preferably 1 percent by mass or less, more preferably 0.5 percent by mass or less, and furthermore preferably 0.1 percent by mass or less. The base steel sheet may generally contain Al in a content of about 0.01 percent by mass, because Al is added as a deoxidizer during steel making.

[Phosphorus (P) in a Content of 0.03 Percent by Mass or Less (Exclusive of 0 Percent by Mass)]

Phosphorus (P) element is effective to obtain a high-strength steel sheet. However, excessive phosphorus may often cause uneven plating and may impede alloying of the galvanized coating. For these reasons, the phosphorus content is controlled to be 0.03 percent by mass or less. The phosphorus content is preferably 0.02 percent by mass or less, and more preferably 0.015 percent by mass or less.

[Sulfur (S) in a Content of 0.03 Percent by Mass or Less (Exclusive of 0 Percent by Mass)]

Sulfur (S) element contaminates the steel as an inevitable impurity, and, if present in excess, may cause hot cracks during hot rolling and may significantly impair spot weldability. The steel, if containing sulfur in excess, may suffer the formation of excessively large amounts of precipitates, and thus may suffer poor elongation and insufficient stretch flangeability. To avoid these, the sulfur content is controlled to be 0.03 percent by mass or less. The sulfur content is preferably 0.02 percent by mass or less, and more preferably 0.01 percent by mass or less.

[Titanium (Ti) in a Content of 0.003 to 1 Percent by Mass]

Titanium (Ti) element fixes carbon in the steel to form carbides and thereby effectively increases the strength of the GA steel sheet. The Ti element not only fixes carbon but also fixes nitrogen in the steel to form nitrides and thereby increases the gamma value (Lankford value) to improve the workability. Ti, as added in combination with Cu and Ni, forms a complex iron oxide upon melting of iron. The complex oxide improves the coating adhesion. The Ti element also contributes to the formation of dense iron rust and dense zinc rust both of which help to improve the corrosion resistance upon corrosion. Specifically, the Ti element is the only one element which suppresses the formation of β-FeOOH. The β-FeOOH causes deterioration in corrosion resistance in a chloride environment. The suppression effect is more satisfactorily exhibited when Ti is added in combination with α-FeOOH which improves the corrosion resistance, and/or with Cu and Ni which accelerates the formation of amorphous rust. The base steel sheet for use herein should contain Ti in a content of 0.003 percent by mass or more. The Ti content is preferably 0.0035 percent by mass or more, and more preferably 0.004 percent by mass or more. However, Ti, if contained in excess, may cause higher cost and may adversely affect the workability. To avoid these, the upper limit of the Ti content is 1 percent by mass. The Ti content is preferably 0.5 percent by mass or less, and more preferably 0.1 percent by mass or less.

The reminder of the GA steel sheet according to one embodiment of the present invention includes iron and inevitable impurities.

The GA steel sheet according to the present invention may further contain one or more selective elements such as V, Nb, Mo, B, Ca, and Mg within ranges not adversely affecting the advantageous effects of the present invention. Preferred contents of the selective elements, if added, are as follows.

[One or More Elements Selected from the Group Consisting of Vanadium (V) in a Content of 1 Percent by Mass or Less (Exclusive of 0 Percent by Mass), Niobium (Nb) in a Content of 1 Percent by Mass or Less (Exclusive of 0 Percent by Mass), and Molybdenum (Mo) in a Content of 1 Percent by Mass or Less (Exclusive of 0 Percent by Mass)]

Vanadium (V), niobium (Nb), and molybdenum (Mo) elements each further improve the strength, and each of these elements may be added alone or in combination. Among them, the vanadium and niobium elements fix carbon in the steel to form carbides and thereby increase the strength. The molybdenum element dissolves in the steel to increase the strength without impairing the coating adhesion. The effects are exhibited by adding small amounts of V, Nb, and/or Mo, and the steel preferably contains any of these elements in a content of 0.003 percent by mass or more, more preferably in a content of 0.01 percent by mass or more, and furthermore preferably in a content of 0.02 percent by mass or more. However, V, Nb, and Mo, if present in excess, may cause higher cost and may impair the workability. To avoid these, the upper limit of the content of each element is preferably 1 percent by mass. The V, Nb, and Mo contents are each more preferably 0.8 percent by mass or less, and furthermore preferably 0.5 percent by mass or less. When two or three of V, Nb, and Mo are contained, the total content thereof is preferably 1 percent by mass or less.

[Boron (B) in a Content of 0.1 Percent by Mass or Less (Exclusive of 0 Percent by Mass)]

Boron (B) element increases the hardenability and improves the weldability. To exhibit these effects effectively, boron is preferably contained in a content of 0.0002 percent by mass or more. The boron content is more preferably 0.0003 percent by mass or more, and furthermore preferably 0.0004 percent by mass or more. However, the effects obtained by the addition of boron are saturated when boron is contained in excess, and, in this case, the ductility is lowered to impair the workability. To avoid these, the boron content is preferably 0.1 percent by mass or less. The boron content is more preferably 0.01 percent by mass or less, and furthermore preferably 0.001 percent by mass or less.

The above-mentioned elements V, Nb, Mo, and B suppress the oxidation of Si and Mn in the surface of the base steel sheet and thereby improve the coating adhesion. In addition, V, Nb, Mo, and B are segregated at grain boundaries, thereby effectively allow the alloying of the galvanized layer (zinc plated layer) to proceed uniformly, and reduce the uneven alloying and defective plating.

[Calcium (Ca) in a Content of 0.005 Percent by Mass or Less (Exclusive of 0 Percent by Mass) and/or Magnesium (Mg) in a Content of 0.01 Percent by Mass or Less (Exclusive of 0 Percent by Mass)]

Calcium (Ca) and magnesium (Mg) elements increase the ductility and improve the workability by allowing inclusions in the steel to be spherical. In addition, Ca and Mg help to clean or decontaminate the steel, and, when contained in the steel, further facilitate the alloying of the galvanized layer to proceed uniformly. To exhibit these effects effectively, the Ca and Mg contents are each preferably 0.0005 percent by mass or more, and more preferably 0.001 percent by mass or more. However, the presence of Ca and Mg in excess may increase the amounts of inclusions in the steel and may impair the ductility, resulting in insufficient workability. To avoid these, the Ca content is preferably 0.005 percent by mass or less, and more preferably 0.003 percent by mass or less. The Mg content is preferably 0.01 percent by mass or less, more preferably 0.005 percent by mass or less, and furthermore preferably 0.003 percent by mass or less.

The GA steel sheet according to the present invention has the chemical composition as described above, but may further contain any of other elements within ranges not adversely affecting the advantageous effects of the present invention.

The GA steel sheet according to the present invention having a chemical composition satisfying the above conditions has a tensile strength of 590 to 1470 MPa grade and has strength and ductility in good balance.

The base steel sheet for use in one embodiment of the present invention has such a metal structure as to include a composite microstructure of ferrite and martensite as its matrix microstructure. As used herein the "matrix microstructure" refers to a microstructure which occupies 70% or more of the entire metal structure.

The fractions of ferrite and martensite in the matrix microstructure are not critical and may be determined according to the balance between the strength and elongation required of the GA steel sheet.

In general, with an increasing ferrite fraction, the GA steel sheet tends to have a decreasing strength but an increasing elongation. In contrast, with an increasing martensite fraction, the GA steel sheet tends to have an increasing strength but a decreasing elongation. The ferrite fraction and the martensite fraction in the metal structure may be 5 to 90 percent by volume and 5 to 90 percent by volume, respectively, so as to ensure the ductility of the GA steel sheet. The ferrite may be a regular ferrite or a plate-like bainitic ferrite having a high dislocation density. Specifically, the matrix microstructure of the base steel sheet for use in one embodiment of the present invention is not critical, as long as being a composite microstructure of martensite in combination with ferrite and/or bainitic ferrite.

Independently, if the base steel sheet for use in the embodiment includes retained γ, the retained γ transforms into martensite upon deformation of the GA steel sheet and causes cracking. To avoid this, the content of retained γ is preferably controlled to be 1 percent by area or less.

Such a base steel sheet including a composite microstructure of ferrite and martensite in a content of 70 percent by area or more and having a controlled content of retained γ of 1 percent by area or less may be produced by subjecting a slab having a chemical composition satisfying the above conditions sequentially to hot rolling and acid pickling. Where necessary, cold rolling may be performed. The resulting hot-rolled steel sheet or cold-rolled steel sheet as the base steel sheet is subjected to hot-dip galvanization and subsequently to alloying typically in a hot-dip galvanization line. Conditions for the production will be described concretely below.

The hot rolling is preferably performed under conditions typically of a heating temperature of about 1100° C. to 1300° C., a finish rolling temperature of about 800° C. to 950° C., and a coiling temperature of about 700° C. or lower.

The heating temperature is preferably set to be about 1100° C. to 1300° C., for ensuring the finish rolling temperature and for preventing the austenite grains to be coarse. The finish rolling temperature is preferably set to be about 800° C. to 950° C., so as to prevent the formation of an aggregate structure (texture) which adversely affects the workability. The coiling temperature is preferably set to be about 700° C. or lower, because the base steel sheet, if coiled at a temperature higher than about 700° C., may have an excessively thick scale in the surface thereof and may thereby undergo acid pickling insufficiently. The average cooling rate after the finish rolling is preferably controlled in the range of about 30° C. to 120° C. per second, for suppressing the formation of pearlite.

Cold rolling may be performed according to necessity after the hot rolling, to improve the workability of the base steel sheet. The cold rolling is preferably performed to a reduction ratio of 30% or more. If the cold rolling is performed to a reduction ratio of less than 30%, the hot rolling should be performed on the base steel sheet to a desired thickness of the resulting product, resulting in poor productivity. When the cold rolling is performed, the scale formed in the surface of the hot-rolled steel sheet may be previously removed through acid pickling.

The hot-rolled steel sheet or cold-rolled steel sheet is, where necessary, subjected to acid pickling for cleaning or decontaminating the surface of the base steel sheet, and is subjected to a heat treatment in a continuous hot-dip galvanization line. To obtain a desired microstructure reliably, the base steel sheet is heated preferably to a temperature of 700° C. or higher. Though not critical, the upper limit of the heating temperature may be set to be 900° C. without problems. The heat treatment may be performed for a holding time of 10 seconds or longer, to achieve sufficient soaking and to give a desired microstructure.

After the heat treatment, galvanization is performed. The galvanizing bath temperature is preferably about 400° C. to 500° C., for easy regulation of galvanization and in consideration of conditions of the subsequent alloying process. The galvanizing bath temperature is more preferably about 440° C. to 480° C. The immersion in the galvanizing bath is preferably performed for 1 to 5 seconds. Though not critical, the galvanizing bath preferably has a composition having an effective Al concentration of typically 0.07 to 0.13 percent by mass. It is recommended to heat the base steel sheet to a temperature around the galvanizing bath temperature, prior to the immersion in the galvanizing bath. This is preferable for the improvement of coating adhesion.

The galvanized steel sheet is further subjected to alloying. The alloying conditions may be determined according to the desired properties. Typically, the alloying may be performed at a temperature of about 400° C. to 600° C. for a duration of about 1 to 300 seconds.

The alloying may be performed using a heating furnace, direct fire, or an infrared heating furnace. The heating process is not limited and can be any of customary processes such as gas heating and heating with an induction heater (heating using an induction heating apparatus). The alloying is preferably performed immediately after the hot-dip galvanization.

<< (b) TRIP Steel Sheet Containing Retained γ in a Content of 3 Percent by Area or More>>

[Carbon (C) in a Content of 0.02 to 0.25 Percent by Mass]

Carbon (C) element is necessary for ensuring strength, contributes to changing of the amount and state (structure) of a low-temperature transformation product, and affects the elongation and stretch flangeability. Accordingly, the base steel sheet should contain carbon in a content of 0.02 percent by mass or more. The carbon content is preferably 0.04 percent by mass or more, and more preferably 0.06 percent by mass or more. However, the base steel sheet, if containing carbon in a content of more than 0.25 percent by mass, shows insufficient weldability, and the carbon content should be 0.25 percent by mass or less. The carbon content is preferably 0.2 percent by mass or less, and more preferably 0.18 percent by mass or less.

[Silicon (Si) in a Content of 0.5 to 3 Percent by Mass]

Silicon (Si) element is a substitutional solid-solution strengthening element and improves the strength by reducing the content of dissolved carbon in the alpha layer. Silicon, if contained in a high content, increases the ferrite fraction and suppresses the bainite transformation of the low-temperature transformation phase to accelerate the formation of martensite. This allows the metal structure to be a composite microstructure of ferrite and martensite. Accordingly, Si element also helps to improve the workability, such as elongation, of the high-strength steel sheet. To exhibit these effects satisfactorily, the base steel sheet should contain Si in a content of 0.5 percent by mass or more. It is recommended that the TRIP steel sheet contains Si in a content of 1 percent by mass or more. This is because the Si element helps to suppress the decomposition of retained γ and the formation of carbides. The Si content is more preferably 1.2 percent by mass or more. However, Si, if present in excess, may forma silicon oxide layer in the surface of the base steel sheet and thereby impair the wettability of plating to fail to reduce defective plating and uneven alloying. In addition, excessive Si forms an oxide film in the surface of the base steel sheet during hot rolling, and this increases the cost for the removal of scales and flaws and is economically disadvantageous. Even the base steel sheet contains Si in an excessively high content, the above-mentioned strength improving effects are saturated, and the base steel sheet suffers higher cost. For these reasons, the Si content is 3 percent by mass or less. The Si content is preferably 2.5 percent by mass or less, and more preferably 2 percent by mass or less.

[Manganese (Mn) in a Content of 1 to 4 Percent by Mass]

Manganese (Mn) element is necessary for increasing the strength and ductility and should be contained in a content of 1 percent by mass or more. The Mn content is preferably 1.3 percent by mass or more, and more preferably 1.5 percent by mass or more. However, Mn, if present in excess, forms a manganese oxide layer in the surface of the base steel sheet and thereby impairs the wettability of plating to fail to reduce defective plating and uneven alloying, as with Si. In addition, excessive Mn forms an oxide film in the surface of the base steel sheet during hot rolling, and this increases the cost for the removal of scales and flaws and is economically disadvantageous. Even the base steel sheet contains Mn in an excessively high content, the above-mentioned strength improving effects are saturated, and the base steel sheet suffers higher cost. For these reasons, the Mn content is set to be 4 percent by mass or less. The Mn content is preferably 3.5 percent by mass or less, and more preferably 3 percent by mass or less.

[Chromium (Cr) in a Content of 0.03 to 1 Percent by Mass]

Chromium (Cr) element is effective to increase hardenability and to strengthen the microstructure. Accordingly, Cr should be contained in a content of 0.03 percent by mass or more. The Cr content is preferably 0.1 percent by mass or more, and more preferably 0.15 percent by mass or more. However, the effects are saturated and the cost increases if Cr is contained in a content of more than 1 percent by mass, and the upper limit of the Cr content is set to be 1 percent by mass. The Cr content is preferably 0.8 percent by mass or less, and more preferably 0.6 percent by mass or less.

[Aluminum (Al) in a Content of 1.5 Percent by Mass or Less (Exclusive of 0 Percent by Mass)]

Aluminum (Al) element helps to improve corrosion resistance and hydrogen-embrittlement resistance. The addition of Al improves the hydrogen-embrittlement resistance, probably because the addition of Al improves the corrosion resistance, resulting in reduction of the amount of hydrogen generated through atmospheric corrosion, and also probably because the addition stabilizes the lath-like retained γ. However, Al, if present in excess, may form large amounts of inclusions such as alumina and thereby impair the workability. To avoid this, the Al content is set to be 1.5 percent by mass or less. The Al content is preferably 1 percent by mass or less, more preferably 0.5 percent by mass or less, and furthermore preferably 0.1 percent by mass or less. The base steel sheet may generally contain Al in a content of about 0.01 percent by mass, because Al is added as a deoxidizer during steel making.

[Phosphorus (P) in a Content of 0.03 Percent by Mass or Less (Exclusive of 0 Percent by Mass)]

Phosphorus (P) element is effective to obtain a high-strength steel sheet. However, excessive phosphorus may often cause uneven plating and may impede alloying of the galvanized coating. To avoid these, the phosphorus content is controlled to be 0.03 percent by mass or less. The phosphorus content is preferably 0.02 percent by mass or less, and more preferably 0.015 percent by mass or less.

[Sulfur (S) in a Content of 0.03 Percent by Mass or Less (Exclusive of 0 Percent by Mass)]

Sulfur (S) element is contaminated as an inevitable impurity, and, if contained in excess, may cause hot cracks during hot rolling and may significantly impair spot weldability. The steel, if containing sulfur in excess, may suffer the formation of excessively large amounts of precipitates therein, and thus may suffer poor elongation and insufficient stretch flangeability. To avoid these, the sulfur content is controlled to be 0.03 percent by mass or less. The sulfur content is preferably 0.02 percent by mass or less, and more preferably 0.01 percent by mass or less.

[Titanium (Ti) in a Content of 0.003 to 1 Percent by Mass]

Titanium (Ti) element fixes carbon in the steel to form a carbide and thereby effectively increases the strength of the GA steel sheet. The Ti element not only fixes carbon but also fixes nitrogen in the steel to form a nitride and thereby increases the gamma value (Lankford value) to improve the workability. Ti, as added in combination with Cu and Ni, forms a complex iron oxide upon melting of iron. The complex oxide improves the coating adhesion. The Ti element also contributes to the formation of dense iron rust and dense zinc rust both of which help to improve the corrosion resistance upon corrosion. Specifically, the Ti element is the only one element which suppresses the formation of β-FeOOH. The β-FeOOH causes deterioration in corrosion resistance in a chloride environment. The suppression effect is more satisfactorily exhibited when Ti is added in combination with α-FeOOH which improves the corrosion resistance, and/or with Cu and Ni which accelerates the formation of amorphous rust. The base steel sheet according to the present invention should contain Ti in a content of 0.003 percent by mass or more. The Ti content is preferably 0.0035 percent by mass or more, and more preferably 0.004 percent by mass or more. However, Ti, if contained in excess, may cause higher cost and may adversely affect the workability. To avoid these, the upper limit of the Ti content is herein 1 percent by mass. The Ti content is preferably 0.5 percent by mass or less, and more preferably 0.1 percent by mass or less.

The remainder of the GA steel sheet according to the present invention includes iron and inevitable impurities.

The GA steel sheet according to the present invention may further contain one or more selective elements such as V, Nb, Mo, B, Ca, and Mg within ranges not adversely affecting the advantageous effects of the present invention. Preferred contents of the selective elements, if added, are as follows.

[One or More Elements Selected from the Group Consisting of Vanadium (V) in a Content of 1 Percent by Mass or Less (Exclusive of 0 Percent by Mass), Niobium (Nb) in a Content of 1 Percent by Mass or Less (Exclusive of 0 Percent by Mass), and Molybdenum (Mo) in a Content of 1 Percent by Mass or Less (Exclusive of 0 Percent by Mass)]

Vanadium (V), niobium (Nb), and molybdenum (Mo) elements each further improve the strength, and each of these elements may be added alone or in combination. Among them, the vanadium and niobium elements fix carbon in the steel to form carbides and thereby increase the strength. The molybdenum element dissolves in the steel to increase the strength without impairing the coating adhesion. The effects are exhibited by adding small amounts of V, Nb, and/or Mo, and the steel preferably contains any of these elements in a content of 0.003 percent by mass or more, more preferably in a content of 0.01 percent by mass or more, and furthermore preferably in a content of 0.02 percent by mass or more. However, V, Nb, and Mo, if present in excess, may cause higher cost and may impair the workability. To avoid these, the upper limit of the content of each element is preferably 1 percent by mass. The V, Nb, and Mo contents are each more preferably 0.8 percent by mass or less, and furthermore preferably 0.5 percent by mass or less. When two or three of V, Nb, and Mo are contained, the total content thereof is preferably 1 percent by mass or less.

[Boron (B) in a Content of 0.1 Percent by Mass or Less (Exclusive of 0 Percent by Mass)]

Boron (B) element increases the hardenability and improves the weldability. To exhibit these effects effectively, boron is preferably contained in a content of 0.0002 percent by mass or more. The boron content is more preferably 0.0003 percent by mass or more, and furthermore preferably 0.0004 percent by mass or more. However, the effects obtained by the addition of boron are saturated when boron is contained in excess, and, in this case, the ductility is lowered to impair the workability. To avoid these, the boron content is preferably 0.1 percent by mass or less. The boron content is more preferably 0.01 percent by mass or less, and furthermore preferably 0.001 percent by mass or less.

The above-mentioned elements V, Nb, Mo, and B suppress the oxidation of Si and Mn in the surface of the base steel sheet and thereby improve the coating adhesion. In addition, V, Nb, Mo, and B segregate at grain boundaries, thereby effectively allow the alloying of the galvanized layer (zinc plated layer) to proceed uniformly, and reduce uneven alloying and defective plating.

[Calcium (Ca) in a Content of 0.005 Percent by Mass or Less (Exclusive of 0 Percent by Mass) and/or Magnesium (Mg) in a Content of 0.01 Percent by Mass or Less (Exclusive of 0 Percent by Mass)]

Calcium (Ca) and magnesium (Mg) elements help inclusions in the steel to be spherical and thereby increase the ductility and improve the workability. In addition, Ca and Mg help to clean or decontaminate the steel, and, when contained in the steel, further facilitate the alloying of the galvanized layer to proceed uniformly. To exhibit these effects effectively, the Ca and Mg contents are each preferably 0.0005 percent by mass or more, and more preferably 0.001 percent by mass or more. However, the presence of Ca and Mg in excess may increase the amounts of inclusions in the steel and may impair the ductility, resulting in insufficient workability. To avoid these, the Ca content is preferably 0.005 percent by mass or less, and more preferably 0.003 percent by mass or less; and the Mg content is preferably 0.01 percent by mass or less, more preferably 0.005 percent by mass or less, and furthermore preferably 0.003 percent by mass or less.

The GA steel sheet according to the present invention has the chemical composition as described above, but may further contain any of other elements within ranges not adversely affecting the advantageous effects of the present invention.

The GA steel sheet according to the present invention having a chemical composition satisfying the above conditions has a tensile strength on the order of 590 to 1470 MPa and has strength and ductility in good balance.

The GA steel sheet according to the present invention may also be a TRIP steel sheet which includes retained γ in a content of 3 percent by area or more. The presence of the retained γ improves the workability. In addition, the presence of the retained γ at grain boundaries reduces the occurrence of defective plating and uneven alloying and allows the steel sheet to have a good appearance, because it suppresses an abrupt reaction between Fe and Zn via the grain boundaries. The retained γ, as dispersed or distributed, helps to disperse anodic sites which cause corrosion. As a result, fine depressions and protrusions are formed in the surface upon corrosion, and general corrosion occurs in macroscopic observation. However, the formed fine depressions and protrusions in the surface prevent pitting corrosion, in which the surface is locally corroded to form pits. Particularly in the case of a thin steel sheet, uniform general corrosion is desired rather than pitting corrosion, because pitting corrosion, if generated and penetrates the thin steel sheet, is industrially very dangerous.

To exhibit the effects effectively, the retained γ is contained preferably in a content of 3 percent by area or more, with respect to the total metal structure. It is recommended that the retained γ is dispersed as finely as possible.

The retained γ grains are preferably dispersed in a lath morphology and each have an average axial ratio ((major axis)/(minor axis)) of 5 or more. This is because the retained γ is present at grain boundaries and thereby has effects of suppressing the abrupt reaction between zinc and iron via the grain boundaries, suppressing uneven appearance caused by such abrupt reaction, and reducing uneven alloying and defective plating. The retained γ exhibits the effects more satisfactorily when it is finely dispersed than when it is present as coarse grains, because such finely dispersed retained γ allows the reaction to proceed uniformly.

Average axial ratios of the retained γ grains may be determined, for example, by observing the metal structure using an FE-SEM equipped with an EBSP detector.

The metal structure other than the retained γ mainly contains bainitic ferrite and may further contain bainite and/or martensite.

The metal structure other than the retained γ may be such that the bainitic ferrite occupies 70 percent by area or more of the entire metal structure. However, the fraction of the bainitic ferrite and the fraction of bainite and/or martensite in the composite microstructure are not critical and may be set according to the desired balance between strength and elongation of the steel sheet.

Such a steel sheet containing bainitic ferrite in a content of 70 percent by area or more and retained γ in a content of 3 percent by area or more may be produced, for example, in the following manner. A slab having a chemical composition satisfying the conditions is subjected to hot rolling, to acid pickling, and, where necessary, to cold rolling. The resulting steel is heated to and held at a temperature in the austenite single phase zone (this temperature is hereinafter referred to as "T1"), cooled at an average cooling rate of 10° C. or more per second, and held at a temperature in the range of 300° C. to 600° C. (this temperature is hereinafter referred to as "To") for 30 seconds or longer. When a process such as hot-dip galvanization is performed typically in a hot-dip galvanization line, the hot-dip galvanization is preferably performed at the temperature To. The conditions for the production will be described in detail below.

The hot rolling is preferably performed under conditions typically of a heating temperature of about 1100° C. to 1300° C., a finish rolling temperature of about 800° C. to 950° C., and a coiling temperature of about 700° C. or lower.

The heating temperature is preferably set to be about 1100° C. to 1300° C., for ensuring the finish rolling temperature and for preventing the austenite grains to be coarse. The finish rolling temperature is preferably set to be about 800° C. to 950° C., so as to prevent the formation of an aggregate structure (texture) which adversely affects the workability. The coiling temperature is preferably set to be about 700° C. or lower, because the base steel sheet, if coiled at a temperature higher than about 700° C., may have an excessively thick scale in the surface thereof and may thereby undergo acid pickling insufficiently. The average cooling rate after the finish rolling is preferably controlled in the range of about 30° C. to 120° C. per second, for suppressing the formation of pearlite.

Cold rolling may be performed according to necessity after the hot rolling, to improve the workability of the base steel sheet. The cold rolling is preferably performed to a reduction ratio of 30% or more. If the cold rolling is performed to a reduction ratio of less than 30%, the hot rolling should be performed on the base steel sheet to a desired thickness of the resulting product, resulting in poor productivity. When the cold rolling is performed, the scale formed in the surface of the hot-rolled steel sheet may be previously removed through acid pickling.

Next, the hot-rolled steel sheet or cold-rolled steel sheet is subjected to the following heat treatment in a continuous hot-dip galvanization line. Specifically, the steel sheet is heated to and held at the temperature (T1) in the austenite single phase zone and is then cooled. The holding time at T1 may be set within such a range as to allow the metal structure of the steel sheet to be austenite and may be, for example, 10 seconds or longer. However, an excessively long holding time may impair the productivity, and the holding time is preferably 1200 seconds or shorter, and more preferably 600 seconds or shorter.

After holding the steel sheet at the temperatures T1, the steel sheet is cooled at an average cooling rate of 10° C. or more per second so as to be held at the temperature (To) in the range of from 300° C. to 600° C. for 30 seconds or longer. Holding of the steel sheet at the temperature To for 30 seconds or longer allows austenite to be finely dispersed to thereby form a desired retained γ. In particular, the holding temperature To is preferably set to be a lower temperature range so as to allow the retained γ to be fine and in a lath-like form having a large average axial ratio. The cooling from T1 to To, if performed at an excessively low cooling rate, may cause pearlite transformation. To avoid this, the average cooling rate from T1 to To is preferably 10° C. or more per second.

Next, the heat-treated steel sheet is subjected sequentially to hot-dip galvanization and alloying.

The hot-dip galvanization may be performed at a temperature in the temperature zone To. Specifically, the galvanizing bath temperature is preferably about 400° C. to 500° C., for easy regulation of galvanization and in consideration of conditions of the subsequent alloying process. The galvanizing bath temperature is more preferably about 440° C. to 480° C. The immersion in the galvanizing bath is preferably performed for 1 to 5 seconds. Though not critical, the galvanizing bath preferably has a composition having an effective Al concentration of typically 0.07 to 0.13 percent by mass. It is recommended to heat the base steel sheet to a temperature around the galvanizing bath temperature, prior to the immersion in the galvanizing bath. This is preferable for the improvement of coating adhesion.

The galvanized steel sheet is further subjected to alloying. The alloying is preferably performed for a duration in the range of 1 to 30 seconds while holding the galvanized steel sheet at a temperature in the temperature zone To.

The alloying may be performed using a heating furnace, direct fire, or an infrared heating furnace. The heating process is not limited and can be any of customary processes such as gas heating and heating with an induction heater (heating using an induction heating apparatus).

The alloying conditions may be determined according to the desired properties. Typically, the alloying may be performed at a temperature of about 450° C. to 550° C. for a duration of about 5 to 30 seconds.

GA steel sheets according to embodiments of the present invention are usable for the manufacture of automotive strengthening parts including bumping parts such as front and rear side members and crush boxes; pillars such as center pillar reinforcing members; and body-constituting parts such as roof rail reinforcing members, side sills, floor members, and kick-up portions (or kick plates).

The GA steel sheets may have been subjected to any of painting and prime coating treatments (e.g., chemical conversion such as phosphating) and organic coating treatments (e.g., the formation of an organic coating typically through film lamination).

Usable in paints are known resins such as epoxy resins, fluorocarbon resins, silicone-acrylic resins, polyurethane resins, acrylic resins, polyester resins, phenolic resins, alkyd resins, and melamine resins. Among them, epoxy resins, fluorocarbon resins, and silicone-acrylic resins are preferred from the viewpoint of corrosion resistance. The paint for use herein may further contain a curing agent in addition to the resin. The paint may further contain any of known additives such as coloring pigments, coupling agents, leveling agents, sensitizers, antioxidants, ultraviolet stabilizers, and flame retardants.

The form of the paint for use herein is not limited, and any of paints of every form can be used. Examples thereof include solvent paints, aqueous paints, aqueous disperse paints, powder paints, and electrodeposition paints. The painting process is also not limited and can be, for example, dipping, roll coating, spraying, curtain flow coating, or electropainting. The thicknesses of the coated layers (plated layer, organic coating, chemical conversion coating, and painted coating) may be set appropriately according to the intended use of the steel sheet.

EXAMPLES

The present invention will be illustrated in further detail with reference to several experimental examples below. It should be noted, however, that these examples are never intended to limit the scope of the present invention; various alternations and modifications may be made without departing from the scope and spirit of the present invention and all fall within the scope of the present invention.

Production was performed in following Experimental Example 1 as intended to give DP steel sheets having a metal structure satisfying the conditions (a); and production was performed in following Experimental Example 2 as intended to give TRIP steel sheets having a metal structure satisfying the conditions (b).

Experimental Example 1

Molten steels having the chemical compositions given in Table 1 (with the remainder being iron and inevitable impurities) were cast, the resulting slabs were heated to 1180° C., and subjected to hot rolling with a finish temperature of 890° C. to 900° C. The hot-rolled steel sheets were cooled to 500° C. at an average cooling rate of 50° C. per second and coiled at this temperature (500° C.). Next, they were subjected to acid pickling and to cold rolling and thereby yielded cold-rolled steel sheets 1.2 mm thick. The reduction ratio in cold rolling was 30%.

TABLE 1

| Steel | Chemical composition (percent by mass) | | | | | | | | | | | | | | | | |
|---|---|---|---|---|---|---|---|---|---|---|---|---|---|---|---|---|---|
| type | C | Si | Mn | P | S | Al | Cr | Cu | Ni | Ti | V | Nb | Mo | B | Ca | Mg | [Cu]/[Ni] |
| A | 0.09 | 1.80 | 2.21 | 0.011 | 0.002 | 0.043 | 0.18 | — | — | — | — | — | — | — | — | — | — |
| B | 0.09 | 1.50 | 2.19 | 0.011 | 0.002 | 0.042 | 0.18 | 0.1 | 0.05 | 0.032 | — | — | — | — | — | — | 2.0 |
| C | 0.10 | 1.48 | 2.30 | 0.012 | 0.002 | 0.042 | 0.17 | 0.2 | 0.05 | 0.033 | — | — | — | — | — | — | 4.0 |
| D | 0.09 | 0.02 | 2.76 | 0.011 | 0.002 | 0.043 | 0.18 | 0.5 | — | 0.033 | — | — | — | — | — | — | — |
| E | 0.08 | 1.80 | 1.81 | 0.010 | 0.002 | 0.042 | 0.18 | 0.3 | 0.05 | 0.035 | — | — | — | — | — | — | 6.0 |
| F | 0.09 | 1.20 | 2.30 | 0.011 | 0.002 | 0.045 | 0.18 | 0.5 | 0.06 | 0.040 | — | — | — | — | — | — | 8.3 |

TABLE 1-continued

| Steel type | Chemical composition (percent by mass) C | Si | Mn | P | S | Al | Cr | Cu | Ni | Ti | V | Nb | Mo | B | Ca | Mg | [Cu]/[Ni] |
|---|---|---|---|---|---|---|---|---|---|---|---|---|---|---|---|---|---|
| G | 0.09 | 0.60 | 2.72 | 0.012 | 0.002 | 0.043 | 0.20 | 0.4 | 0.05 | 0.040 | — | — | — | — | — | — | 8.0 |
| H | 0.15 | 1.50 | 2.40 | 0.011 | 0.002 | 0.044 | 0.18 | 0.3 | 0.05 | 0.035 | — | — | — | — | — | — | 6.0 |
| I | 0.09 | 1.45 | 2.21 | 0.011 | 0.002 | 0.043 | 0.21 | 0.5 | 0.06 | 0.040 | — | — | — | — | — | — | 8.3 |
| J | 0.17 | 1.80 | 2.29 | 0.010 | 0.002 | 0.043 | 0.60 | 0.4 | 0.05 | 0.040 | — | — | — | — | — | — | 8.0 |
| K | 0.09 | 0.60 | 3.21 | 0.013 | 0.002 | 0.043 | 0.18 | 0.3 | 0.05 | 0.040 | — | — | 0.03 | — | — | — | 6.0 |
| L | 0.16 | 1.61 | 2.35 | 0.011 | 0.002 | 0.044 | 0.19 | 0.4 | 0.06 | 0.052 | — | — | 0.03 | 0.0009 | — | — | 6.7 |
| M | 0.12 | 0.87 | 2.31 | 0.011 | 0.002 | 0.043 | 0.18 | 0.4 | 0.05 | 0.035 | 0.1 | — | 0.03 | — | — | — | 8.0 |
| N | 0.09 | 1.21 | 2.98 | 0.011 | 0.002 | 0.043 | 0.20 | 0.9 | 0.15 | 0.040 | — | 0.05 | 0.07 | — | — | — | 6.0 |
| 0 | 0.10 | 0.94 | 2.32 | 0.011 | 0.002 | 0.045 | 0.18 | 0.6 | 0.10 | 0.035 | — | — | 0.07 | 0.0009 | — | — | 6.0 |
| P | 0.13 | 1.46 | 2.30 | 0.011 | 0.002 | 0.043 | 0.17 | 0.35 | 0.05 | 0.040 | — | — | 0.15 | — | 0.0012 | — | 7.0 |
| Q | 0.09 | 1.78 | 2.45 | 0.011 | 0.002 | 0.043 | 0.18 | 0.45 | 0.05 | 0.070 | — | — | 0.31 | 0.0004 | — | 0.0010 | 9.0 |

The prepared cold-rolled steel sheets were processed to a size of 100 mm wide and 250 mm long, subjected sequentially to annealing, reduction, hot-dip galvanization, and alloying using a hot-dip galvanization simulator, and thereby yielded GA steel sheets. Specifically, the cold-rolled steel sheets were subjected to acid pickling to clean their surface, annealed at 800° C. for 30 seconds, and subjected to reduction in a reducing atmosphere containing 20% of $H_2$ at 860° C. for 45 seconds. The reduced cold-rolled steel sheets were subjected to hot-dip galvanization by immersing in a galvanizing bath containing 0.13% of Al at a bath temperature of 460° C. for 2 seconds.

The alloying after the hot-dip galvanization was performed using an infrared heating furnace in the galvanization simulator immediately after the hot-dip galvanization. The alloying was performed at a temperature of 550° C. for a duration of 15 seconds.

The metal structures of the produced GA steel sheets were observed under a scanning electron microscope (SEM) at a magnification of 3000 times. As a result, the steel sheets were each found to have a composite microstructure of ferrite and martensite as a matrix microstructure of their metal structure. The contents of retained γ were determined according to the method described in Experimental Example 2 below. As a result, the steel sheets each had a content of retained γ of 1 percent by area or less (not shown in Table 1).

Next, the above-produced GA steel sheets were evaluated on platability and powdering resistance.

<<Evaluation of Platability>>

The platability was evaluated by visually observing whether an unplated portion was present and whether uneven alloying occurred. The presence of unplated portion and the occurrence of uneven alloying were evaluated based on the area percentage according to the following criteria. The evaluated data are shown in Table 2. Samples having platability of Grade 3 to Grade 5 are acceptable in the present invention.

(Evaluation Criteria)

Grade 5: No unplated portion and no uneven alloying is observed.

Grade 4: No unplated portion but slight uneven alloying (less than 5% in area percentage) is observed.

Grade 3: No unplated portion but partial uneven alloying (5% or more and less than 10% in area percentage) is observed.

Grade 2: No unplated portion but uneven alloying (10% or more in area percentage) is observed.

Grade 1: One or more unplated portion and uneven alloying (10% or more in area percentage) are observed.

<<Evaluation of Powdering Resistance>>

The GA steel sheets were subjected to V-bending tests using a V-shaped punch at a bending angle of 60 degrees and a bending radius of 1 mm. The amounts of peeled plating inside of the bent portion were measured, and the powdering resistance was evaluated according to the following criteria. The evaluated data are shown in Table 2. Samples having a powdering resistance of Grade ◎ or Grade 0 are acceptable herein.

(Evaluation Criteria)

Grade ◎: The amount of peeled plating is 6 mg or less.

Grade ○: The amount of peeled plating is more than 6 mg and 10 mg or less.

Grade ×: The amount of peeled plating is more than 10 mg.

TABLE 2

| Sample No. | Steel type | Platability | Powdering resistance |
|---|---|---|---|
| 1 | A | 1 | x |
| 2 | B | 2 | x |
| 3 | C | 2 | x |
| 4 | D | 1 | x |
| 5 | E | 3 | ○ |
| 6 | F | 3 | ○ |
| 7 | G | 3 | ○ |
| 8 | H | 3 | ○ |
| 9 | I | 3 | ○ |
| 10 | J | 3 | ○ |
| 11 | K | 4 | ◎ |
| 12 | L | 4 | ◎ |
| 13 | M | 4 | ◎ |
| 14 | N | 4 | ◎ |
| 15 | O | 5 | ◎ |
| 16 | P | 5 | ◎ |
| 17 | Q | 5 | ◎ |

Table 1 and Table 2 demonstrate as follows. Sample Nos. 1 to 4 did not satisfy the conditions specified in the present invention, particularly the condition regarding the ratio [Cu]/[Ni], and thereby showed inferior platability and poor powdering resistance. Among them, Sample No. 4 containing no Ni but Cu alone suffered from small flaws in the surface of the steel sheet, showed poor surface quality, and suffered from uneven plating deposition. Accordingly, Sample No. 4 showed inferior platability to Sample Nos. 2 and 3, although it had a Cu content higher than those of Sample Nos. 2 and 3. In contrast, Sample Nos. 5 to 17 satisfying the conditions specified in the present invention showed good platability and had excellent powdering resistance.

Experimental Example 2

Molten steels having the chemical compositions given in Table 3 (with the remainder being iron and inevitable impurities) were cast, the resulting slabs were hot-rolled to give hot-rolled steel sheets 3.2 mm thick, pickled with acid to remove surface scale, cold-rolled, and thereby yielded cold-rolled steel sheets 1.2 mm thick.

| Steel | Chemical compositon (percent by mass) | | | | | | | | | | | | | | | | |
|---|---|---|---|---|---|---|---|---|---|---|---|---|---|---|---|---|---|
| type | C | Si | Mn | P | S | Al | Cr | Cu | Ni | Ti | V | Nb | Mo | B | Ca | Mg | [Cu]/[Ni] |
| a | 0.08 | 1.80 | 2.20 | 0.011 | 0.002 | 0.043 | 0.18 | — | — | — | — | — | — | — | — | — | — |
| b | 0.09 | 1.82 | 2.17 | 0.011 | 0.002 | 0.042 | 0.18 | 0.1 | 0.05 | 0.031 | — | — | — | — | — | — | 2.0 |
| c | 0.08 | 1.56 | 2.42 | 0.011 | 0.002 | 0.044 | 0.19 | 0.2 | 0.05 | 0.032 | — | — | — | — | — | — | 4.0 |
| d | 0.09 | 1.75 | 2.34 | 0.011 | 0.002 | 0 043 | 0.18 | 0.5 | — | 0.032 | — | — | — | — | — | — | — |
| e | 0.16 | 1.52 | 2.65 | 0.010 | 0.002 | 0.042 | 0.21 | 0.3 | 0.05 | 0.035 | — | — | — | — | — | — | 6.0 |
| f | 0.09 | 1.12 | 3.45 | 0.011 | 0.002 | 0.045 | 0.18 | 0.5 | 0.06 | 0.035 | — | — | — | — | — | — | 8.3 |
| g | 0.17 | 1.49 | 2.85 | 0.011 | 0.002 | 0.042 | 0.19 | 0.3 | 0.05 | 0.035 | — | — | — | — | — | — | 6.0 |
| h | 0.18 | 1.80 | 2.55 | 0.013 | 0.002 | 0.045 | 0.23 | 0.5 | 0.06 | 0.070 | — | — | — | — | — | — | 8.3 |
| i | 0.09 | 1.49 | 2.85 | 0.011 | 0.002 | 0.042 | 0.19 | 0.4 | 0.06 | 0.035 | 0.1 | — | 0.03 | — | 0.0012 | — | 6.7 |
| j | 0.08 | 1.30 | 2.55 | 0.013 | 0.002 | 0.045 | 0.23 | 0.6 | 0.10 | 0.040 | — | — | 0.11 | 0.0004 | — | — | 6.0 |
| k | 0.09 | 1.49 | 2.85 | 0.011 | 0.002 | 0.042 | 0.19 | 0.7 | 0.05 | 0.035 | — | 0 05 | 0.07 | — | — | 0.0010 | 14.0 |
| l | 0.08 | 1.30 | 2.55 | 0.013 | 0.002 | 0.045 | 0.23 | 0.5 | 0.06 | 0.040 | — | 0.05 | 0.03 | 0.0009 | 0.0012 | — | 8.3 |
| m | 0.08 | 1.45 | 2.55 | 0.013 | 0.002 | 0.045 | 0.23 | 0.3 | 0.05 | 0.040 | — | — | — | — | — | — | 6.0 |
| n | 0.09 | 1.44 | 2.52 | 0.012 | 0.002 | 0.044 | 0.22 | 0.5 | 0.05 | 0.035 | — | — | — | 0.0009 | — | — | 10.0 |

Specifically, the slabs were held at a start temperature of 1150° C. to 1200° C. for 30 minutes and hot-rolled at a finish temperature of 850° C., then cooled at an average cooling rate of 50° C. per second, coiled at 550° C., and thereby yielded the hot-rolled steel sheets. The cold rolling was then performed to a reduction ratio in cold rolling of 40%.

The prepared cold-rolled steel sheets were processed to a size of 100 mm wide and 250 mm long, subjected sequentially to continuous annealing, hot-dip galvanization, and alloying using a hot-dip galvanization simulator, and thereby yielded GA steel sheets.

The continuous annealing was performed by holding the cold-rolled steel sheets at a temperature within the austenite single phase zone (this temperature is herein after referred to as "T1" and shown in Table 4) for 180 seconds and cooling to the temperature To given in Table 4 at an average cooling rate of 50° C. per second. The continuous annealing was performed in a reducing atmosphere containing 20% of $H_2$.

The hot-dip galvanization was performed by immersing the continuously annealed cold-rolled steel sheets in a galvanizing bath containing Al in a content of 0.13% at a bath temperature of 460° C. for 2 seconds.

The alloying after the hot-dip galvanization was performed using an infrared heating furnace in the galvanization simulator immediately after the hot-dip galvanization. The alloying was performed at a temperature of 550° C. for a duration of 15 seconds.

The metal structures of the produced GA steel sheets were observed under a scanning electron microscope (SEM) at a magnification of 3000 times. As a result, the steel sheets were each found to have a metal structure mainly including bainitic ferrite (in an area percentage of 70% or more based on the total microstructure) and further including retained γ. The amount of the retained γ was measured according to the method mentioned below. The average axial ratio ((major axis)/(minor axis)) of retained γ grains were determined by measuring the axial ratios of retained γ grains observed in one arbitrary view field and averaging the axial ratios. The samples were evaluated on retained γ based on the amount of retained γ and the average axial ratio according to the following criteria. The evaluated data are shown in Table 4. Samples showing Grade ◎ or Grade ○ in retained γ are acceptable herein.

(Evaluation Criteria)

Grade ◎: The amount of retained γ is 3 percent by area or more and average axial ratio is 5 or more.

Grade ○: The amount of retained γ is 3 percent by area or more and average axial ratio is 1 or more and less than 5.

Grade Δ: The amount of retained γ is 1 percent by area or more and less than 3 percent by area.

Grade ×: The amount of retained γ is less than 1 percent by area.

The amount of retained γ was measured as an area of a portion where face-centered cubic (FCC) was observed using an FE-SEM equipped with an electron backscatter diffraction pattern (EBSP) detector. The EBSP detector is a device for determining the crystal orientation at an incident position of electron beams by applying the electron beams to the surface of a specimen, and analyzing a Kikuchi pattern obtained from backscattered electrons generated thereupon. The orientation distribution in the surface of the specimen can be measured by two-dimensionally scanning electron beams on the surface of the specimen, and measuring crystal orientations at every predetermined pitch.

An exemplary measurement procedure is as follows. An object to be measured is an arbitrary measurement area (about 50 μm square, at measurement intervals of 0.1 μm) at a depth of one-fourth the thickness in a plane in parallel with the rolling plane. Polishing to the measurement plane was performed by elecropolishing in order to prevent the transformation of retained γ.

Next, an EBSP image obtained under the FE-SEM equipped with the EBSP detector was taken with a highly sensitive camera and captured as an image into a computer. The image was analyzed, and a face centered cubic lattice (FCC) phase was color-mapped. The FCC phase was determined as comparison with a pattern in a simulation using known crystal systems [face centered cubic lattice (FCC) in the case of retained γ]. The area percentage of the mapped areas was defined as the area percentage of retained γ. The analysis was performed using an orientation imaging microscopy (OEM) supplied by TexSEM Laboratories Inc. as hardware and software.

Independently, the platability and powdering resistance of the above-prepared GA steel sheets were evaluated by the procedure of Experimental Example 1. The evaluated data are shown in Table 4. The corrosion resistance of the GA steel sheets was evaluated in the following manner.

<<Evaluation of Corrosion Resistance>>

A specimen 150 mm long and 50 mm wide was cut from a sample GA steel sheet and subjected to a corrosion cycle test, in which dry and humid conditions were alternately repeated. In the corrosion cycle test, it took for one cycle 8 hours. Specifically, in one cycle, the specimen was exposed to 5% salt spray for 2 hours, dried at 60° C. for 4 hours, and held under humid conditions of 95% relative humidity for 2 hours. In Experimental Example 2, the test was performed by repeating the cycle 45 times (performing 45 cycles). After the test, the rust was removed, the mass of the specimen was measured, and a weight loss (mass loss) caused by corrosion was calculated. The evaluation was performed according to the following criteria, and the results are shown in Table 4. Samples having corrosion resistance of Grade 2 to Grade 5 are acceptable herein.

(Evaluation Criteria)

Grade 5: Corrosion mass loss is 40 mg/cm$^2$ or less.

Grade 4: Corrosion mass loss is more than 40 mg/cm$^2$ and 50 mg/cm$^2$ or less.

Grade 3: Corrosion mass loss is more than 50 mg/cm$^2$ and 60 mg/cm$^2$ or less.

Grade 2: Corrosion mass loss is more than 60 mg/cm$^2$ and 80 mg/cm$^2$ or less.

Grade 1: Corrosion mass loss is more than 80 mg/cm$^2$.

| Sample No. | Steel type | T1 (° C.) | To (° C.) | Retained λ | Plat-ability | Powdering resistance | Corrosion resistance |
|---|---|---|---|---|---|---|---|
| 21 | a | 900 | 475 | X | 1 | X | 1 |
| 22 | b | 900 | 475 | ○ | 2 | X | 1 |
| 23 | c | 900 | 475 | ○ | 2 | X | 2 |
| 24 | d | 900 | 475 | ○ | 1 | X | 2 |
| 25 | e | 900 | 450 | ○ | 3 | ○ | 2 |
| 26 | f | 900 | 450 | ○ | 3 | ○ | 2 |
| 27 | g | 900 | 450 | ○ | 3 | ○ | 2 |
| 28 | h | 900 | 450 | ○ | 3 | ○ | 2 |
| 29 | i | 900 | 425 | ○ | 4 | ◎ | 4 |
| 30 | j | 900 | 425 | ○ | 4 | ◎ | 4 |
| 31 | k | 900 | 425 | ○ | 5 | ◎ | 5 |
| 32 | l | 900 | 425 | ○ | 5 | ◎ | 5 |
| 33 | a | 900 | — | X | 1 | X | 1 |
| 34 | m | 900 | 475 | ○ | 4 | ◎ | 2 |
| 35 | m | 900 | 450 | ◎ | 5 | ◎ | 2 |
| 36 | m | 900 | 425 | ◎ | 5 | ◎ | 2 |
| 37 | n | 900 | 450 | ○ | 4 | ◎ | 3 |
| 38 | n | 900 | 420 | ◎ | 5 | ◎ | 3 |
| 39 | n | 900 | 380 | ◎ | 5 | ◎ | 3 |

Tables 3 and 4 demonstrate as follows. Sample Nos. 21 to 24 and 33 did not satisfy the conditions specified in the present invention, particularly the condition regarding the ratio [Cu]/[Ni], and thereby showed inferior platability and poor powdering resistance. Among them, Sample No. 24 containing no Ni but Cu alone suffered from small flaws in the surface of the steel sheet, showed poor surface quality, and suffered from uneven plating deposition. Accordingly, Sample No. 24 showed inferior platability to Sample Nos. 22 and 23, although it had a Cu content higher than those of Sample Nos. 22 and 23. In addition, Sample Nos. 21 to 24 had a corrosion mass loss of more than 60 mg/cm$^2$ and showed poor corrosion resistance. In contrast, Sample Nos. 25 to 32 and 34 to 39 satisfied the conditions specified in the present invention, thereby showed good platability, and had excellent powdering resistance. In addition, they had a controlled corrosion mass loss of 60 mg/cm$^2$ or less and excelled also in corrosion resistance.

While the present invention has been described in detail with reference to the specific embodiments thereof, it is obvious to those skilled in the art that various changes and modifications can be made in the invention without departing from the spirit and scope of the invention. The present application is based on Japanese Patent Application No. 2008-285705 filed on Nov. 6, 2008, the entire contents of which are incorporated herein by reference.

The invention claimed is:

1. A galvannealed steel sheet, obtained by subjecting a base steel sheet to hot-dip galvanization and then alloying the galvanization layer, wherein a base steel sheet of the galvannealed steel sheet is obtained by hot rolling a steel, the steel comprising:

Fe;

carbon (C) in a content of 0.02 to 0.25 percent by mass;

silicon (Si) in a content of 1 to 3 percent by mass;

manganese (Mn) in a content of 1 to 4 percent by mass;

chromium (Cr) in a content of 0.03 to 1 percent by mass;

aluminum (Al) in a content of 1.5 percent by mass or less, exclusive of 0 percent by mass;

phosphorus (P) in a content of 0.03 percent by mass or less, exclusive of 0 percent by mass;

sulfur (S) in a content of 0.03 percent by mass or less, exclusive of 0 percent by mass;

titanium (Ti) in a content of 0.003 to 1 percent by mass;

copper (Cu) in a content of 0.25 to 5.0 percent by mass; and nickel (Ni) in a content of 0.05 to 1.0 percent by mass, wherein:

the copper and nickel contents satisfy Condition (1):

$$[Cu][/Ni]\geq 5 \quad (1)$$

where [Cu] and [Ni] represent the contents, as a percent by mass, of Cu and Ni, respectively;

the base steel sheet has a metal structure comprising retained austenite in a content of 3 percent by area or more; and the retained austenite has an average axial ratio, (major axis)/(minor axis), of grains of 5 or more.

2. The galvannealed steel sheet of claim 1, wherein the steel comprises Si in a content of 1.2-2 percent by mass.

3. The galvannealed steel sheet of claim 1, wherein the steel further comprises one or more elements selected from the group consisting of:

vanadium (V) in a content of 1 percent by mass or less, exclusive of 0 percent by mass, niobium (Nb) in a content of 1 percent by mass or less, exclusive of 0 percent by mass, and molybdenum (Mo) in a content of 1 percent by mass or less, exclusive of 0 percent by mass.

4. The galvannealed steel sheet of claim 3, wherein the steel comprises boron (B) in a content of 0.1 percent by mass or less, exclusive of 0 percent by mass.

5. The galvannealed steel sheet of claim 4, wherein the steel further comprises at least one element selected from the group consisting of Ca in a content of 0.005 percent by mass or less, exclusive of 0 percent by mass, and Mg in a content of 0.01 percent by mass or less, exclusive of 0 percent by mass.

6. The galvannealed steel sheet of claim 3, wherein the steel further comprises at least one element selected from the group consisting of Ca in a content of 0.005 percent by mass or less, exclusive of 0 percent by mass, and Mg in a content of 0.01 percent by mass or less, exclusive of 0 percent by mass.

7. The galvannealed steel sheet of claim 1, wherein the steel further comprises boron (B) in a content of 0.1 percent by mass or less, exclusive of 0 percent by mass.

8. The galvannealed steel sheet of claim 7, wherein the steel further comprises at least one element selected from the group consisting of Ca in a content of 0.005 percent by mass or less, exclusive of 0 percent by mass, and Mg in a content of 0.01 percent by mass or less, exclusive of 0 percent by mass.

9. The galvannealed steel sheet of claim 1, wherein the steel further comprises at least one element selected from the group consisting of calcium (Ca) in a content of 0.005 percent by mass or less, exclusive of 0 percent by mass, and magnesium (Mg) in a content of 0.01 percent by mass or less, exclusive of 0 percent by mass.

10. A method for producing the galvannealed steel sheet of claim 1, the method comprising:

subjecting the steel to hot rolling to give a base steel sheet;

subjecting the base steel sheet to hot-dip galvanization to give a galvanized steel sheet; and alloying the galvanized steel sheet.

* * * * *